US010366561B2

(12) United States Patent
Collette et al.

(10) Patent No.: US 10,366,561 B2
(45) Date of Patent: Jul. 30, 2019

(54) SYSTEMS, METHODS AND DEVICES FOR PLAYING WAGERING GAMES WITH RANDOMIZED CLUMPING OF SYMBOLS

(71) Applicant: Bally Gaming, Inc., Las Vegas, NV (US)

(72) Inventors: Shawn C. Collette, Henderson, NV (US); Joel R. Jaffe, Glenview, IL (US); Brad Schultz, Las Vegas, NV (US); Benjamin T. Gomez, Chicago, IL (US); Jamie W. Vann, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 11 days.

(21) Appl. No.: 15/133,153

(22) Filed: Apr. 19, 2016

(65) Prior Publication Data

US 2016/0232755 A1 Aug. 11, 2016

Related U.S. Application Data

(63) Continuation of application No. 14/936,788, filed on Nov. 10, 2015, now Pat. No. 9,330,527, which is a (Continued)

(51) Int. Cl.
*G07F 17/32* (2006.01)
*G07F 17/34* (2006.01)

(52) U.S. Cl.
CPC ..... *G07F 17/3213* (2013.01); *G07F 17/326* (2013.01); *G07F 17/3244* (2013.01); *G07F 17/34* (2013.01)

(58) Field of Classification Search
CPC ..... G07F 17/32; G07F 17/34; G07F 17/3211; G07F 17/3213; G07F 17/3244; G07F 17/3265; A63F 2001/008
See application file for complete search history.

(56) References Cited

U.S. PATENT DOCUMENTS 6,056,642 A 5/2000 Bennett
6,146,271 A * 11/2000 Kadlic ..... A63F 1/00 273/292

(Continued)

FOREIGN PATENT DOCUMENTS

AU 2004203045 7/2004
AU 2007254668 12/2007

(Continued)

OTHER PUBLICATIONS

Patent Examination Report No. 1; Australian Patent Application No. 2011239259; dated Dec. 18, 2012; (3 pages).

(Continued)

*Primary Examiner* — David Duffy
*Assistant Examiner* — Ankit B Doshi
(74) *Attorney, Agent, or Firm* — Grant A. Dingledine

(57) ABSTRACT

Gaming devices, gaming systems, methods of conducting a wagering game, and computer programs for initiating a wagering game are presented herein. A gaming system is presented that includes a wager input device, a display device, and game-logic circuitry. The wager input device receives wagers from players to play the wagering game. The display device displays outcomes of the wagering game via a plurality of symbol-bearing reels each having a plurality of symbol positions occupied by symbols, at least one of the reels having a designated clump area comprising a predetermined number of the symbol positions. Prior to displaying the outcome of the wagering game, the game-logic circuitry randomly determines whether to include a symbol clump in the designated clump area, the symbol clump comprising a plurality of identical symbols occupying adjacent ones of the symbol positions within the designated clump area. A symbol clump comprises one or more identical symbols occupying two or more symbol positions (Continued)

located immediately adjacent one another on one reel. The game-logic circuitry directs the display device to display the symbol-bearing reels spinning and stopping to present a randomly determined outcome of the casino wagering game.

26 Claims, 8 Drawing Sheets

Related U.S. Application Data continuation of application No. 13/280,479, filed on Oct. 25, 2011, now Pat. No. 9,214,066.

(60) Provisional application No. 61/410,165, filed on Nov. 4, 2010.

(56) References Cited

U.S. PATENT DOCUMENTS 6,186,894 B1 * 2/2001 Mayeroff ..... G07F 17/32 273/138.1
6,280,328 B1 8/2001 Holch
6,394,902 B1 5/2002 Glavich
6,517,433 B2 2/2003 Loose
6,663,487 B1 12/2003 Ladner
6,695,696 B1 2/2004 Kaminkow
6,910,962 B2 6/2005 Marks
7,690,984 B2 4/2010 Tran
8,096,869 B2 1/2012 Yoshimi
8,235,796 B2 8/2012 Nakamura
8,388,435 B2 * 3/2013 Anderson ..... G07F 17/32 273/143 R
9,214,066 B2 * 12/2015 Collette ..... G07F 17/326
2002/0039920 A1 4/2002 Bryant
2002/0045474 A1 * 4/2002 Singer ..... G07F 17/32 463/20
2003/0045354 A1 3/2003 Giobbi
2003/0087687 A1 5/2003 Locke
2004/0058727 A1 3/2004 Marks
2004/0198481 A1 * 10/2004 Herrington ..... G07F 17/32 463/13
2005/0159208 A1 7/2005 Pacey
2005/0288087 A1 12/2005 Meyer
2006/0084492 A1 4/2006 Baerlocher
2006/0183534 A1 * 8/2006 Yoshimi ..... G07F 17/34 463/20
2009/0227332 A1 * 9/2009 Yoshizawa ..... G07F 17/3265 463/20
2010/0210343 A1 8/2010 Englman
2011/0105218 A1 5/2011 Anderson
2011/0201406 A1 8/2011 Jaffe
2012/0083327 A1 * 4/2012 Zobel ..... G07F 17/3213 463/20

FOREIGN PATENT DOCUMENTS

AU 2010202101 5/2010
WO 2007/089410 8/2007

OTHER PUBLICATIONS

Notice of Acceptance; Australian Patent Application No. 2011239259; dated Apr. 9, 2013; (1 page).

* cited by examiner

SYSTEMS, METHODS AND DEVICES FOR PLAYING WAGERING GAMES WITH RANDOMIZED CLUMPING OF SYMBOLS

CROSS-REFERENCE AND CLAIM OF PRIORITY TO RELATED APPLICATION

This application claims the benefit of and priority to U.S. patent application Ser. No. 14/936,788, filed on Nov. 10, 2015, which is a continuation of U.S. patent application Ser. No. 13/280,479, filed Oct. 25, 2011 now U.S. Pat. No. 9,214,066, and claims benefit of and priority to U.S. Provisional Patent Application No. 61/410,165, which was filed Nov. 4, 2010, each of which is incorporated herein by reference in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

TECHNICAL FIELD

The present disclosure relates generally to gaming devices and wagering games, and more particularly to systems, methods, and devices for playing wagering games with symbol clumps.

BACKGROUND

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators strive to employ the most entertaining and exciting machines, features, and enhancements available because such machines attract frequent play and hence increase profitability to the operator.

One concept that has been successfully employed to enhance the entertainment value of a game is that of a "secondary" or "bonus" game which may be played in conjunction with a "basic" game. The bonus game, which is typically entered upon the occurrence of a selected event or outcome of the basic game, may comprise any type of game, either similar to or completely different from the basic game. Such a bonus game produces a significantly higher level of player excitement than the basic game because it provides a greater expectation of winning than the basic game.

Another concept that has been employed to enhance player entertainment and achieve player loyalty is the use of progressive games. In the gaming industry, a "progressive" game involves collecting coin-in data from participating gaming device(s) (e.g., slot machines), contributing a percentage of that coin-in data to a progressive jackpot amount, and awarding that jackpot amount to a player upon the occurrence of a certain jackpot-won event. A jackpot-won event typically occurs when a "progressive winning position" is achieved at a participating gaming device. If the gaming device is a slot machine, a progressive winning position may, for example, correspond to alignment of progressive jackpot reel symbols along a certain payline. Typically, the initial progressive jackpot is a predetermined minimum amount. That jackpot amount, however, progressively increases as players continue to play the gaming machine without winning the jackpot. Typically, once the progressive jackpot is awarded, the jackpot amount is reset to the predetermined minimum amount.

Conventional slot-type wagering games include a plurality of symbol-bearing reels, each of which has a plurality of distinct symbol positions and bears an array of symbols. Traditionally, slot-type gaming machines display selected outcomes of symbols and award players for game outcomes with winning symbols and combinations of symbols in accordance with a pay table. To enhance player entertainment and excitement, some slot-type gaming machines have employed "clumping" of symbols, where groups or "clumps" of the same symbol appear adjacent to one another on vertical reels. By occupying multiple symbol positions with one or more of the same symbols, a symbol clump typically increases the likelihood of achieving a winning outcome and corresponding award. In general, the number of symbol clumps, as well as the respective location and size of each symbol clump, on any given reel are customarily preset and unchangeable. In addition, given the increased likelihood of a winning outcome, the clumps are typically permanently assigned to symbols corresponding to relatively lower awards on the pay table. If symbols corresponding to higher awards are clumped, the frequency of the occurrence of such clumped symbols is permanently reduced to maintain a predetermined level or range of payout percentage.

There is still a need for additional concepts to enhance the entertainment value of slot-type wagering games. Although a lot of focus is now being paid to enhancing bonus games, there is still room for improving the basic wagering game.

SUMMARY

According to one aspect of the present disclosure, a gaming system for playing a wagering game is featured. The wagering game includes a plurality of symbol-bearing reels, each of which has a plurality of distinct symbol positions. The gaming system includes an input device for receiving wagers from players to play the wagering game, and a display for displaying outcomes of the wagering game. The wagering-game outcomes are randomly determined from a plurality of wagering-game outcomes. The gaming system also includes at least one controller that is operatively coupled to the display. The at least one controller is configured to: determine, prior to displaying the outcome of the wagering game via the display, whether to add at least one symbol clump to at least one of the plurality of reels, the at least one symbol clump comprising one or more identical symbols occupying two or more of the symbol positions located immediately adjacent one another on the at least one reel; instruct the display, responsive to a determination to add at least one symbol clump to at least one reel, to incorporate the symbol clump onto the at least one reel, the symbol clump being capable of being displayed on the at least one reel; and instruct the display to display the outcome of the wagering game.

According to another aspect of the present disclosure, a gaming system is presented. The gaming system includes means for receiving a wager from a player to play a wagering game. The wagering game includes a plurality of reels, each of the reels having a plurality of distinct symbol positions and a number of symbols. The gaming system also includes means for determining an outcome of the wagering game, the outcome being randomly determined from a plurality of wagering-game outcomes. In addition to the above, the gaming system also includes means for displaying the outcome of the wagering game, and means for executing the wagering game. Executing the wagering game includes: determining, prior to displaying the outcome of the wagering game, whether to add at least one symbol clump to at least one of the plurality of reels; responsive to a determination to add at least one symbol clump, incorporating the symbol clump to the at least one reel, the symbol clump being capable of being displayed on the at least one reel; and instructing the means for displaying to display the outcome of the wagering game.

According to yet another aspect of the present disclosure, a method of conducting a wagering game is presented. The wagering game includes a plurality of symbol-bearing reels. The method comprises: determining, via at least one processor, an outcome of the wagering game, the wagering-game outcome being randomly determined from a plurality of wagering-game outcomes; determining, prior to displaying the outcome of the wagering game via a display device, whether to add at least one symbol clump to at least one of the plurality of reels; responsive to a determination to add at least one symbol clump, visually indicating on at least one display the addition of the at least one symbol clump to the at least one reel; causing a display device to display the wagering-game outcome subsequent to the determination of whether to add at least one symbol clump to the at least one of the reels; and awarding a corresponding award if the wagering-game outcome corresponds to at least one of the plurality of predefined winning outcomes.

According to even yet another aspect of the present disclosure, one or more non-transient computer readable storage media are encoded with instructions for directing a gaming device or a gaming system to perform any of the above or below methods.

The above summary is not intended to represent each embodiment or every aspect of the present disclosure. Rather, the summary merely provides an exemplification of some of the novel features presented herein. The above features and advantages, and other features and advantages of the present disclosure, will be readily apparent from the following detailed description of the embodiments and best modes for carrying out the present invention when taken in connection with the accompanying drawings and the appended claims.

Figure 1A:
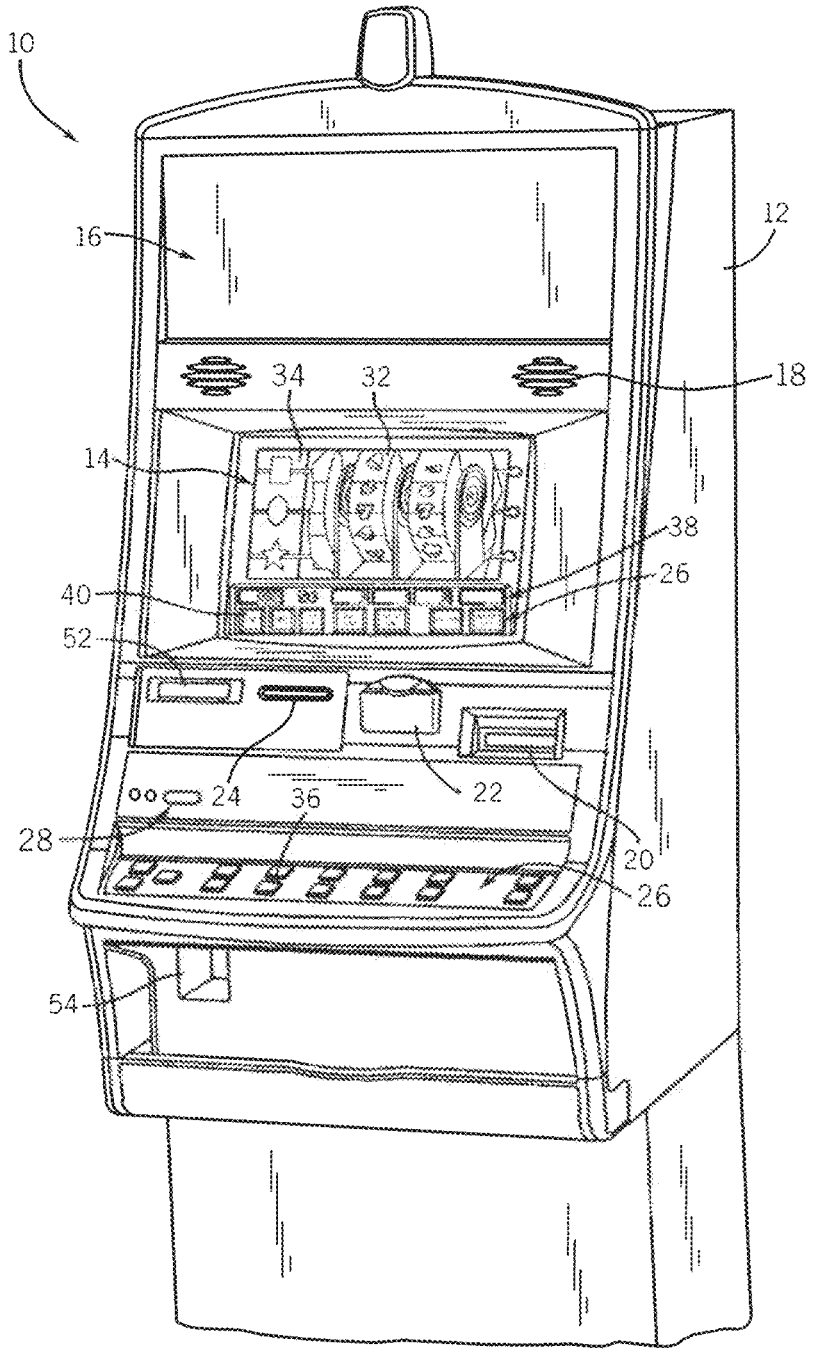
FIG. 1A is a perspective-view illustration of an exemplary free-standing gaming terminal according to embodiments of the present disclosure.

While the invention is susceptible to various modifications and alternative forms, specific embodiments have been shown by way of example in the drawings and will be described in detail herein. It should be understood, however, that the present invention is not intended to be limited to the particular forms disclosed. Rather, the invention is to cover all modifications, equivalents, and alternatives falling within the spirit and scope of the invention as defined by the appended claims.

DETAILED DESCRIPTION OF THE EXEMPLARY EMBODIMENTS

While this invention is susceptible of embodiment in many different forms, there are shown in the drawings and will herein be described in detail representative embodiments with the understanding that the present disclosure is to be considered as an exemplification of the various aspects and principles of the invention, and is not intended to limit the broad aspect of the invention to the embodiments illustrated. To that extent, elements and limitations that are disclosed, for example, in the Abstract, Summary, and Detailed Description of the Embodiments sections, but not explicitly set forth in the claims, should not be incorporated into the claims, singly or collectively, by implication, inference or otherwise.

Figure 1B:
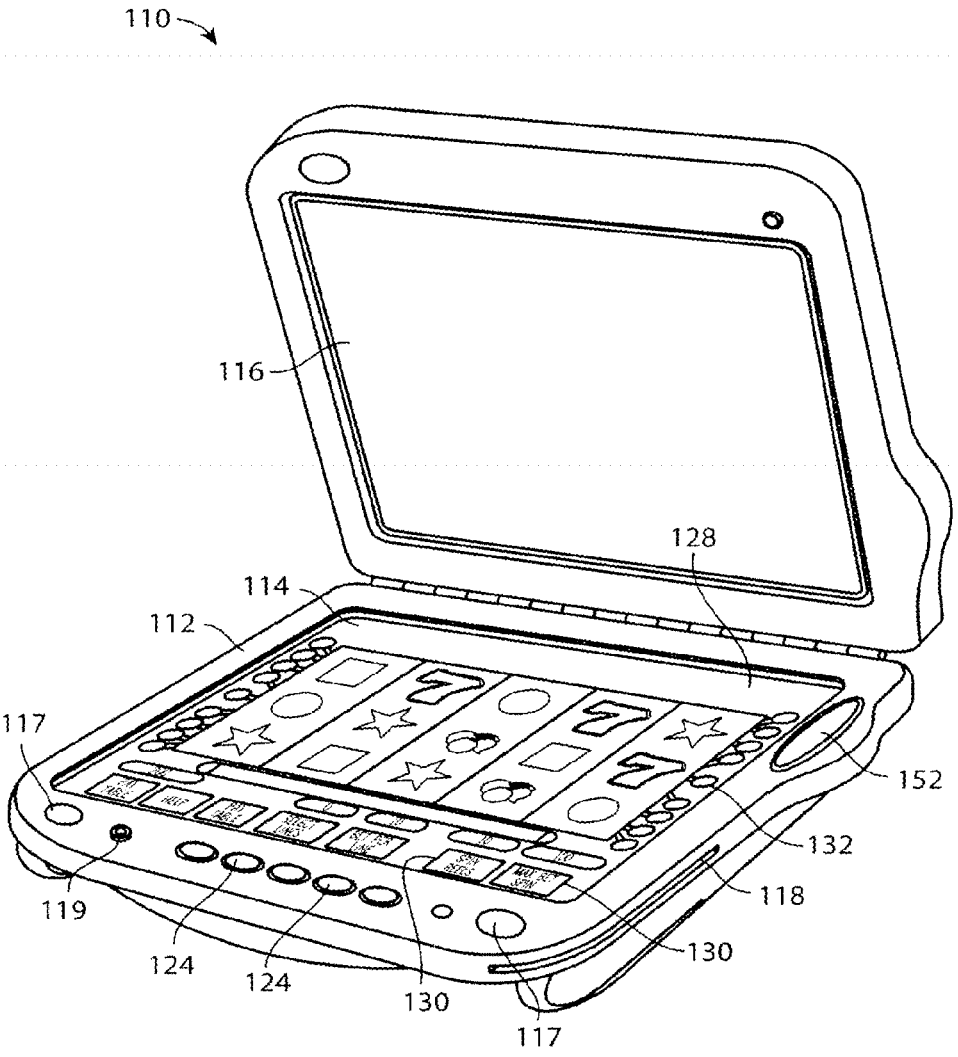
FIG. 1B is a perspective-view illustration of an exemplary handheld gaming device according to embodiments of the present disclosure.

Referring to FIG. 1, there is shown a gaming terminal 10 similar to those used in gaming establishments, such as casinos. With regard to the present disclosure, the gaming terminal 10 may be any type of gaming terminal and may have varying structures and methods of operation. For example, in some aspects, the gaming terminal 10 can be an electromechanical gaming terminal configured to play mechanical slots, whereas in other aspects, the gaming terminal is an electronic gaming terminal configured to play a video casino game, such as slots, keno, poker, blackjack, roulette, craps, etc. It should be understood that although the gaming terminal 10 is shown as a free-standing terminal of the upright type, the gaming terminal is readily amenable to implementation in a wide variety of other forms such as a free-standing terminal of the slant-top type, a portable or handheld device primarily used for gaming, such as is disclosed by way of example in PCT Patent Application No. PCT/US2007/000792 filed Jan. 11, 2007, titled "Handheld Device for Wagering Games," which is incorporated herein by reference in its entirety, a mobile telecommunications device such as a mobile telephone or personal digital assistant (PDA), a counter-top or bar-top gaming terminal, or other personal electronic device, such as a portable television, MP3 player, entertainment device, etcetera.

The gaming terminal 10 illustrated in FIG. 1 comprises a cabinet or housing 12. For output devices, this embodiment of the gaming terminal 10 includes a primary display area 14, a secondary display area 16, and one or more audio speakers 18. The primary display area 14 and/or secondary display area 16 variously displays information associated with wagering games, non-wagering games, community games, progressives, advertisements, services, premium entertainment, text messaging, emails, alerts or announcements, broadcast information, subscription information, etc. appropriate to the particular mode(s) of operation of the gaming terminal. For input devices, the gaming terminal 10 illustrated in FIG. 1 includes a bill validator 20, a coin acceptor 22, one or more information readers 24, one or more player-input devices 26, and one or more player-accessible ports 28 (e.g., an audio output jack for headphones, a video headset jack, a wireless transmitter/receiver, etc.). While these typical components found in the gaming terminal 10 are described below, it should be understood that numerous other peripheral devices and other elements exist and are readily utilizable in any number of combinations to create various forms of a gaming terminal in accord with the present concepts.

The primary display area 14 include, in various aspects of the present concepts, a mechanical-reel display, a video display, or a combination thereof in which a transmissive video display is disposed in front of the mechanical-reel display to portray a video image in superposition over the mechanical-reel display. Further information concerning the latter construction is disclosed in U.S. Pat. No. 6,517,433 to Loose et al. entitled "Reel Spinning Slot Machine With Superimposed Video Image," which is incorporated herein by reference in its entirety. The video display is, in various embodiments, a cathode ray tube (CRT), a high-resolution liquid crystal display (LCD), a plasma display, a light emitting diode (LED), a DLP projection display, an electroluminescent (EL) panel, or any other type of display suitable for use in the gaming terminal 10, or other form factor, such as is shown by way of example in FIG. 1. The primary display area 14 includes, in relation to many aspects of wagering games conducted on the gaming terminal 10, one or more paylines 30 (see FIG. 3) extending along a portion of the primary display area. In the illustrated embodiment of FIG. 1, the primary display area 14 comprises a plurality of mechanical reels 32 and a video display 34, such as a transmissive display (or a reflected image arrangement in other embodiments), in front of the mechanical reels 32. If the wagering game conducted via the gaming terminal 10 relies upon the video display 34 only and not the mechanical reels 32, the mechanical reels 32 are optionally removed from the interior of the terminal and the video display 34 is advantageously of a non-transmissive type. Similarly, if the wagering game conducted via the gaming terminal 10 relies only upon the mechanical reels 32, but not the video display 34, the video display 34 depicted in FIG. 1 is replaced with a conventional glass panel. Further, in still other embodiments, the video display 34 is disposed to overlay another video display, rather than a mechanical-reel display, such that the primary display area 14 includes layered or superimposed video displays. In yet other embodiments, the mechanical-reel display of the above-noted embodiments is replaced with another mechanical or physical member or members such as, but not limited to, a mechanical wheel (e.g., a roulette game), dice, a pachinko board, or a diorama presenting a three-dimensional model of a game environment.

Video images in the primary display area 14 and/or the secondary display area 16 are rendered in two-dimensional (e.g., using Flash Macromedia™) or three-dimensional graphics (e.g., using Renderware™). In various aspects, the video images are played back (e.g., from a recording stored on the gaming terminal 10), streamed (e.g., from a gaming network), or received as a TV signal (e.g., either broadcast or via cable) and such images can take different forms, such as animated images, computer-generated images, or "real-life" images, either prerecorded (e.g., in the case of marketing/promotional material) or as live footage. The format of the video images can include any format including, but not limited to, an analog format, a standard digital format, or a high-definition (HD) digital format.

The player-input or user-input device(s) 26 include, by way of example, a plurality of buttons 36 on a button panel, as shown in FIG. 1, a mouse, a joy stick, a switch, a microphone, and/or a touch screen 38 mounted over the primary display area 14 and/or the secondary display area 16 and having one or more soft touch keys 40, as is also shown in FIG. 1. In still other aspects, the player-input devices 26 comprise technologies that do not rely upon physical contact between the player and the gaming terminal, such as speech-recognition technology, gesture-sensing technology, eye-tracking technology, etc. The player-input or user-input device(s) 26 thus accept(s) player input(s) and transforms the player input(s) to electronic data signals indicative of a player input or inputs corresponding to an enabled feature for such input(s) at a time of activation (e.g., pressing a "Max Bet" button or soft key to indicate a player's desire to place a maximum wager to play the wagering game). The input(s), once transformed into electronic data signals, are output to a CPU or controller 42 (see FIG. 2) for processing. The electronic data signals are selected from a group consisting essentially of an electrical current, an electrical voltage, an electrical charge, an optical signal, an optical element, a magnetic signal, and a magnetic element.

The information reader 24 (or information reader/writer) is preferably located on the front of the housing 12 and comprises, in at least some forms, a ticket reader, card reader, bar code scanner, wireless transceiver (e.g., RFID, Bluetooth, etc.), biometric reader, or computer-readable-storage-medium interface. As noted, the information reader may comprise a physical and/or electronic writing element to permit writing to a ticket, a card, or computer-readable-storage-medium. The information reader 24 permits information to be transmitted from a portable medium (e.g., ticket, voucher, coupon, casino card, smart card, debit card, credit card, etc.) to the information reader 24 to enable the gaming terminal 10 or associated external system to access an account associated with cashless gaming, to facilitate player tracking or game customization, to retrieve a saved-game state, to store a current-game state, to cause data transfer, and/or to facilitate access to casino services, such as is more fully disclosed, by way of example, in U.S. Patent Publication No. 2003/0045354, published on Mar. 6, 2003, entitled "Portable Data Unit for Communicating With Gaming Machine Over Wireless Link," which is incorporated herein by reference in its entirety. The noted account associated with cashless gaming is, in some aspects of the present concepts, stored at an external system 46 (see FIG. 2) as more fully disclosed in U.S. Pat. No. 6,280,328 to Holch et al. entitled "Cashless Computerized Video Game System and Method," which is incorporated herein by reference in its entirety, or is alternatively stored directly on the portable storage medium. Various security protocols or features can be used to enhance security of the portable storage medium. For example, in some aspects, the individual carrying the portable storage medium is required to enter a secondary independent authenticator (e.g., password, PIN number, biometric, etc.) to access the account stored on the portable storage medium.

Figure 2:
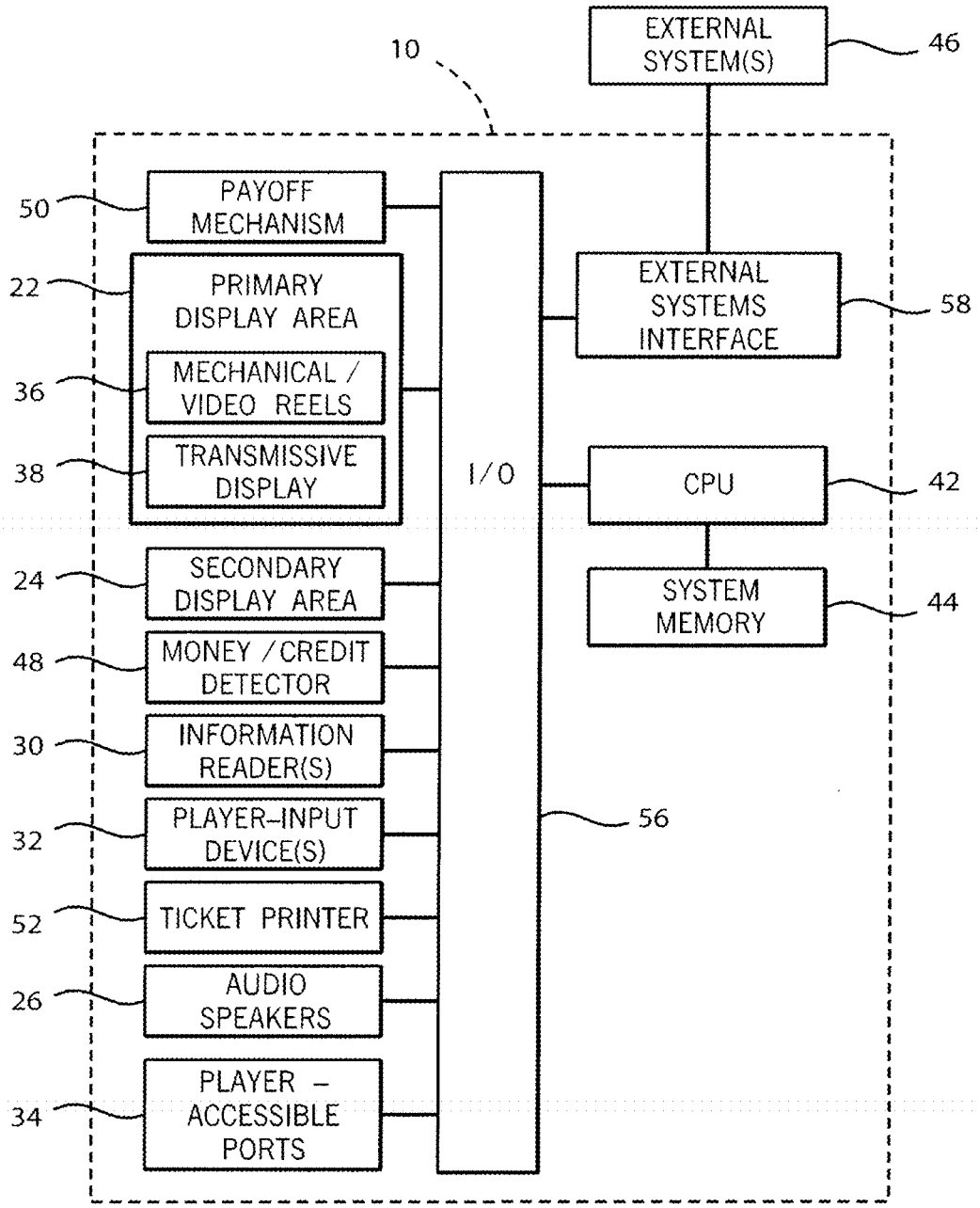
FIG. 2 is a schematic diagram of an exemplary gaming system according to embodiments of the present disclosure.

Turning now to FIG. 2, the various components of the gaming terminal 10 are controlled by one or more processors (e.g., CPU, distributed processors, etc.) 42, also referred to herein generally as a controller (e.g., microcontroller, microprocessor, etc.). The controller 42 can include any suitable processor(s), such as an Intel® Pentium processor, Intel® Core 2 Duo processor, AMD Opteron™ processor, or UltraSPARC® processor. By way of example, the controller 42 includes a plurality of microprocessors including a master processor, a slave processor, and a secondary or parallel processor. Controller 42, as used herein, comprises any combination of hardware, software, and/or firmware disposed in and/or disposed outside of the gaming terminal 10 that is configured to communicate with and/or control the transfer of data between the gaming terminal 10 and a bus, another computer, processor, or device and/or a service and/or a network. The controller 42 comprises one or more controllers or processors and such one or more controllers or processors need not be disposed proximal to one another and may be located in different devices and/or in different locations. For example, a first processor is disposed proximate a user interface device (e.g., a push button panel, a touch screen display, etc.) and a second processor is disposed remotely from the first processor, the first and second processors being electrically connected through a network. As another example, the first processor is disposed in a first enclosure (e.g., a gaming machine) and a second processor is disposed in a second enclosure (e.g., a server) separate from the first enclosure, the first and second processors being communicatively connected through a network. The controller 42 is operable to execute all of the various gaming methods and other processes disclosed herein.

To provide gaming functions, the controller 42 executes one or more game programs comprising machine-executable instructions stored in local and/or remote computer-readable data storage media (e.g., memory 44 or other suitable storage device). The term computer-readable data storage media, or "computer-readable medium," as used herein refers to any media/medium that participates in providing instructions to controller 42 for execution. The computer-readable medium comprises, in at least some exemplary forms, non-volatile media (e.g., optical disks, magnetic disks, etc.), volatile media (e.g., dynamic memory, RAM), and transmission media (e.g., coaxial cables, copper wire, fiber optics, radio frequency (RF) data communication, infrared (IR) data communication, etc). Common forms of computer-readable media include, for example, a hard disk, magnetic tape (or other magnetic medium), a 2-D or 3-D optical disc (e.g., a CD-ROM, DVD, etc.), RAM, PROM, EPROM, FLASH-EPROM, any other memory chip or solid state digital data storage device, a carrier wave, or any other medium from which a computer can read. By way of example, a plurality of storage media or devices are provided, a first storage device being disposed proximate the user interface device and a second storage device being disposed remotely from the first storage device, wherein a network is connected intermediate the first one and second one of the storage devices.

Various forms of computer-readable media may be involved in carrying one or more sequences of one or more instructions to controller 42 for execution. By way of example, the instructions may initially be borne on a data storage device of a remote device (e.g., a remote computer, server, or system). The remote device can load the instructions into its dynamic memory and send the instructions over a telephone line or other communication path using a modem or other communication device appropriate to the communication path. A modem or other communication device local to the gaming machine 10 or to an external system 46 associated with the gaming machine can receive the data on the telephone line or conveyed through the communication path (e.g., via external systems interface 58) and output the data to a bus, which transmits the data to the system memory 44 associated with the processor 42, from which system memory the processor retrieves and executes the instructions.

Thus, the controller 42 is able to send and receive data, via carrier signals, through the network(s), network link, and communication interface. The data includes, in various examples, instructions, commands, program code, player data, and game data. As to the game data, in at least some aspects of the present concepts, the controller 42 uses a local random number generator (RNG) to randomly generate a wagering-game outcome from a plurality of possible outcomes. Alternatively, the outcome is centrally determined using either an RNG or pooling scheme at a remote controller included, for example, within the external system 46.

As shown in the example of FIG. 2, the controller 42 is coupled to the system memory 44. The system memory 44 is shown to comprise a volatile memory (e.g., a random-access memory (RAM)) and a non-volatile memory (e.g., an EEPROM), but optionally includes multiple RAM and multiple program memories.

As shown in the example of FIG. 2, the controller 42 is also coupled to a money/credit detector 48. The money/credit detector 48 is configured to output a signal the controller 42 that money and/or credits have been input via one or more value-input devices, such as the bill validator 20, coin acceptor 22, or via other sources, such as a cashless gaming account, etc. The value-input device(s) is integrated with the housing 12 of the gaming terminal 10 and is connected to the remainder of the components of the gaming terminal 10, as appropriate, via a wired connection, such as I/O 56, or wireless connection. The money/credit detector 48 detects the input of valid funds into the gaming terminal 10 (e.g., via currency, electronic funds, ticket, card, etc.) via the value-input device(s) and outputs a signal to the controller 42 carrying data regarding the input value of the valid funds. The controller 42 extracts the data from these signals from the money/credit detector 48, analyzes the associated data, and transforms the data corresponding to the input value into an equivalent credit balance that is available to the player for subsequent wagers on the gaming terminal 10, such transforming of the data being effected by software, hardware, and/or firmware configured to associate the input value to an equivalent credit value. Where the input value is already in a credit value form, such as in a cashless gaming account having stored therein a credit value, the wager is simply deducted from the available credit balance.

As seen in FIG. 2, the controller 42 is also connected to, and controls, the primary display area 14, the player-input device(s) 26, and a payoff mechanism 50. The payoff mechanism 50 is operable in response to instructions from the controller 42 to award a payoff to the player in response to certain winning outcomes that occur in the base game, the bonus game(s), or via an external game or event. The payoff is provided in the form of money, credits, redeemable points, advancement within a game, access to special features within a game, services, another exchangeable media, or any combination thereof. Although payoffs may be paid out in coins and/or currency bills, payoffs are alternatively associated with a coded ticket (from a ticket printer 52), a portable storage medium or device (e.g., a card magnetic strip), or are transferred to or transmitted to a designated player account. The payoff amounts distributed by the payoff mechanism 50 are determined by one or more pay tables stored in the system memory 44.

Communications between the controller 42 and both the peripheral components of the gaming terminal 10 and the external system 46 occur through input/output (I/O) circuit 56, which can include any suitable bus technologies, such as an AGTL+ frontside bus and a PCI backside bus. Although the I/O circuit 56 is shown as a single block, it should be appreciated that the I/O circuit 56 alternatively includes a number of different types of I/O circuits. Furthermore, in some embodiments, the components of the gaming terminal 10 can be interconnected according to any suitable interconnection architecture (e.g., directly connected, hypercube, etc.).

The I/O circuit 56 is connected to an external system interface or communication device 58, which is connected to the external system 46. The controller 42 communicates with the external system 46 via the external system interface 58 and a communication path (e.g., serial, parallel, IR, RC, 10bT, near field, etc.). The external system 46 includes, in various aspects, a gaming network, other gaming terminals, a gaming server, a remote controller, communications hardware, or a variety of other interfaced systems or components, in any combination. In yet other aspects, the external system 46 may comprise a player's portable electronic device (e.g., cellular phone, electronic wallet, etc.) and the external system interface 58 is configured to facilitate wireless communication and data transfer between the portable electronic device and the controller 42, such as by a near field communication path operating via magnetic field induction or a frequency-hopping spread spectrum RF signals (e.g., Bluetooth, etc.).

The gaming terminal 10 optionally communicates with external system 46 (in a wired or wireless manner) such that each terminal operates as a "thin client" having relatively less functionality, a "thick client" having relatively more functionality, or with any range of functionality therebetween (e.g., an "intermediate client"). In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external systems 46 ("thin client" gaming terminal), or are distributed therebetween in any suitable manner ("intermediate client" gaming terminal).

Figure 3:
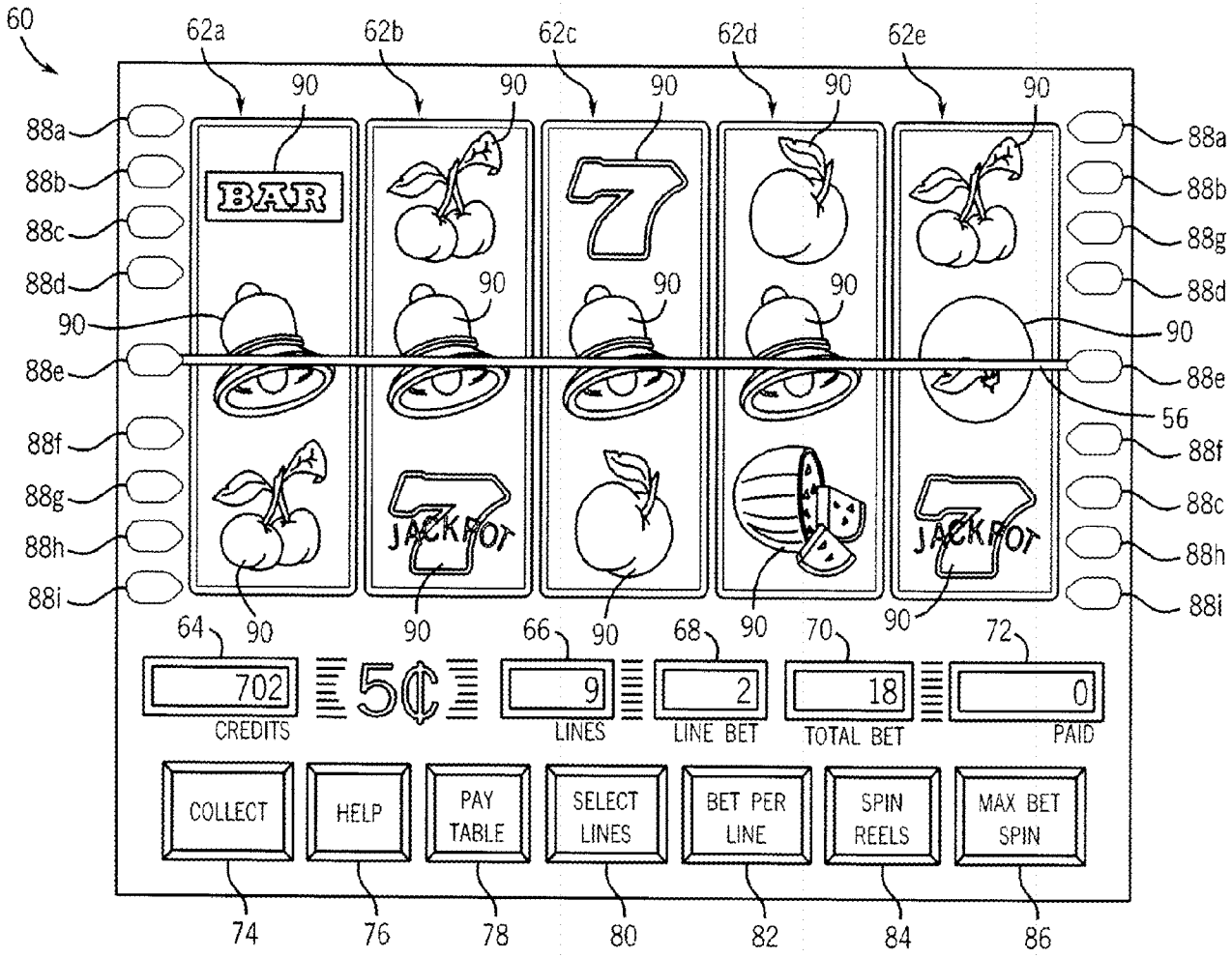
FIG. 3 is a screen shot of a basic-game screen from an exemplary wagering game that can be played, for example, on the gaming terminal of FIG. 1A, the handheld gaming device of FIG. 1B, and the gaming system of FIG. 2.

Referring now to FIG. 3, an image of a basic-game screen 60 adapted to be displayed on the primary display area 14 is illustrated, according to one embodiment of the present disclosure. A player begins play of a basic wagering game by providing a wager. A player can operate or interact with the wagering game using the one or more player-input devices 26. The controller 42, the external system 46, or both, in alternative embodiments, operate(s) to execute a wagering game program causing the primary display area 14 to display the wagering game that includes a plurality of visual elements.

In accord with various methods of conducting a wagering game on a gaming system in accord with the present concepts, the wagering game includes a game sequence in which a player makes a wager, such as through the money/credit detector 48, touch screen 38 soft key, button panel, or the like, and a wagering-game outcome is associated with the wager. The wagering-game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering-game outcome to the player via one or more output devices (e.g., primary display 14) through the display of information such as, but not limited to, text, graphics, text and graphics, static images, moving images, etc., or any combination thereof. In accord with the method of conducting the wagering game, the controller 42, which comprises one or more processors, transforms a physical player input, such as a player's pressing of a "Spin Reels" soft key 84 (see FIG. 3), into an electronic data signal indicative of an instruction relating to the wagering game (e.g., an electronic data signal bearing data on a wager amount).

In the aforementioned method, for each data signal, the controller 42 is configured to processes the electronic data signal, to interpret the data signal (e.g., data signals corresponding to a wager input), and to cause further actions associated with the interpretation of the signal in accord with computer instructions relating to such further actions executed by the controller. As one example, the controller 42 causes the recording of a digital representation of the wager in one or more storage devices (e.g., system memory 44 or a memory associated with an external system 46), the controller, in accord with associated computer instructions, causing the changing of a state of the data storage device from a first state to a second state. This change in state is, for example, effected by changing a magnetization pattern on a magnetically coated surface of a magnetic storage device or changing a magnetic state of a ferromagnetic surface of a magneto-optical disc storage device, a change in state of transistors or capacitors in a volatile or a non-volatile semiconductor memory (e.g., DRAM), etc.). The noted second state of the data storage device comprises storage in the storage device of data representing the electronic data signal from the controller (e.g., the wager in the present example). As another example, the controller 42 further, in accord with the execution of the instructions relating to the wagering game, causes the primary display 14 or other display device and/or other output device (e.g., speakers, lights, communication device, etc.), to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by the RNG) that is used by the controller 42 to determine the outcome of the game sequence, using a game logic for determining the outcome based on the randomly generated number. In at least some aspects, the controller 42 is configured to determine an outcome of the game sequence at least partially in response to the random parameter.

The basic-game screen 60 is displayed on the primary display area 14 or a portion thereof. In FIG. 3, the basic-game screen 60 portrays a plurality of simulated movable reels 62*a-e*. Alternatively or additionally, the basic-game screen 60 portrays a plurality of mechanical reels or other video or mechanical presentation consistent with the game format and theme. The basic-game screen 60 also advantageously displays one or more game-session meters and various buttons adapted to be actuated by a player.

In the illustrated embodiment of FIG. 3, the game-session meters include a "credit" meter 64 for displaying a number of credits available for play on the terminal; a "lines" meter 66 for displaying a number of paylines to be played by a player on the terminal; a "line bet" meter 68 for displaying a number of credits wagered (e.g., from 1 to 5 or more credits) for each of the number of paylines played; a "total bet" meter 70 for displaying a total number of credits wagered for the particular round of wagering; and a "paid" meter 72 for displaying an amount to be awarded based on the results of the particular round's wager. The depicted user-selectable buttons include a "collect" button 74 to collect the credits remaining in the credits meter 64; a "help" button 76 for viewing instructions on how to play the wagering game; a "pay table" button 78 for viewing a pay table associated with the basic wagering game; a "select lines" button 80 for changing the number of paylines (displayed in the lines meter 66) a player wishes to play; a "bet per line" button 82 for changing the amount of the wager which is displayed in the line-bet meter 68; a "spin reels" button 84 for moving the reels 62*a-e*; and a "max bet spin" button 86 for wagering a maximum number of credits and moving the reels 62*a-e* of the basic wagering game. While the gaming terminal 10 allows for these types of player inputs, the present disclosure does not require them and can be used on gaming terminals having more, less, or different player inputs.

As shown in the example of FIG. 3, paylines 30 extend from one of the payline indicators 88*a-i* on the left side of the basic-game screen 60 to a corresponding one of the payline indicators 88*a-i* on the right side of the screen 60. A plurality of symbols 90 is displayed on the plurality of reels 62*a-e* to indicate possible outcomes of the basic wagering game. A winning combination occurs when the displayed symbols 90 correspond to one of the winning symbol combinations listed in a pay table stored in the memory 44 of the terminal 10 or in the external system 46. The symbols 90 may include any appropriate graphical representation or animation, and may further include a "blank" symbol.

Symbol combinations are evaluated in accord with various schemes such as, but not limited to, "line pays" or "scatter pays." Line pays are evaluated left to right, right to left, top to bottom, bottom to top, or any combination thereof by evaluating the number, type, or order of symbols 90 appearing along an activated payline 30. Scatter pays are evaluated without regard to position or paylines and only require that such combination appears anywhere on the reels 62*a-e*. While an embodiment with nine paylines is shown, a wagering game with no paylines, a single payline, or any plurality of paylines will also work with the present disclosure. Additionally, though an embodiment with five reels is shown in FIG. 3, different embodiments of the gaming terminal 10 comprise a greater or lesser number of reels in accordance with the present disclosure.

Figure 5:
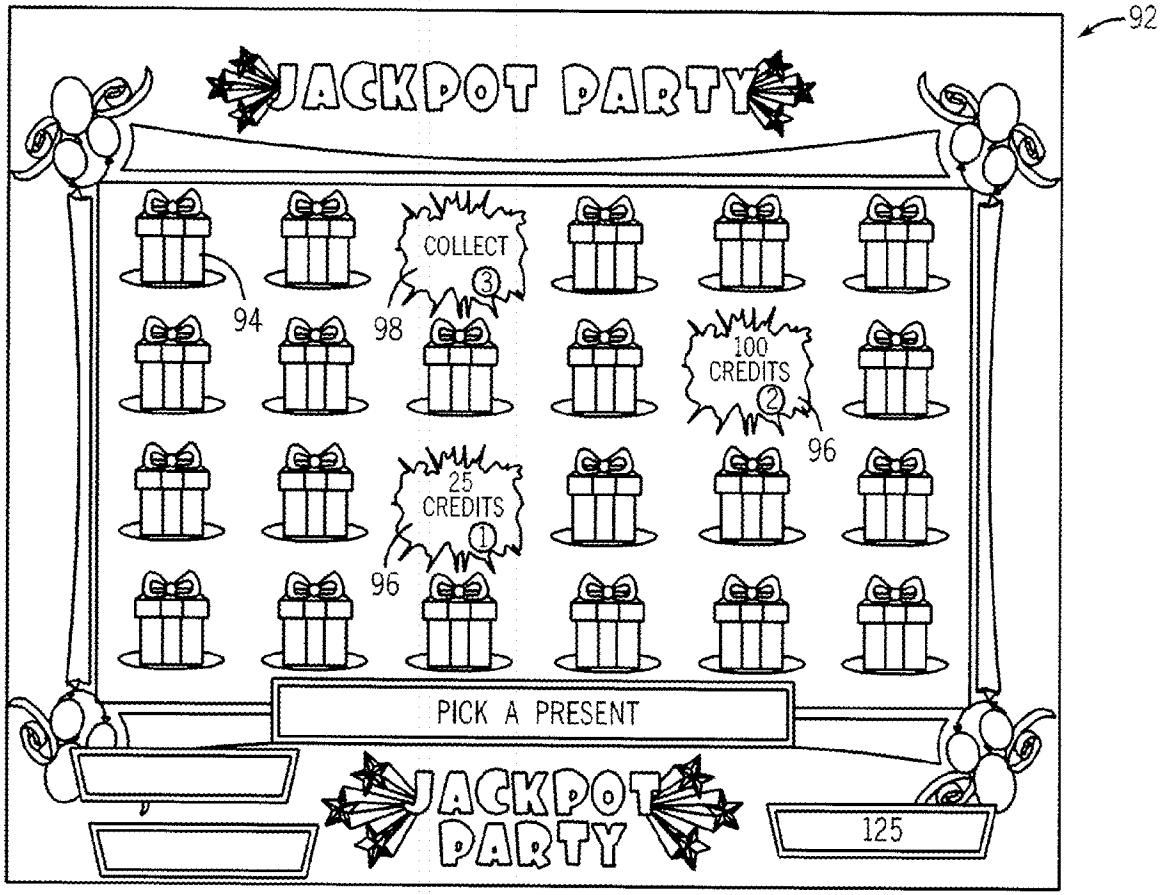
FIG. 5 is a screen shot of a bonus-game screen from an exemplary wagering game that can be played, for example, on the gaming terminal of FIG. 1A, the handheld gaming device of FIG. 1B, or the gaming system of FIG. 2.

Turning now to FIG. 5, an example of a bonus game to a basic wagering game is illustrated. A bonus-game screen 92 includes an array of markers 94 located in a plurality of columns and rows. The bonus game is entered upon the occurrence of a triggering event, such as the occurrence of a start-bonus game outcome (e.g., symbol trigger, mystery trigger, time-based trigger, etc.) in or during the basic wagering game. Alternatively, any bonus game described herein is able to be deployed as a stand-alone wagering game independent of a basic wagering game.

In the illustrated bonus game of FIG. 5, a player selects, one at a time, from the array of markers 94 to reveal an associated bonus-game outcome. According to one embodiment of this bonus game, each marker 94 in the array is associated with an award outcome 96 (e.g., credits or other non-negative outcomes) or an end-game outcome 98. In the illustrated example, a player has selected an award outcome 96 with the player's first two selections (25 credits and 100 credits, respectively). When one or more end-game outcome 98 is selected (as illustrated by the player's third pick), the bonus game is terminated and the accumulated award outcomes 96 are provided to the player.

Figure 6:
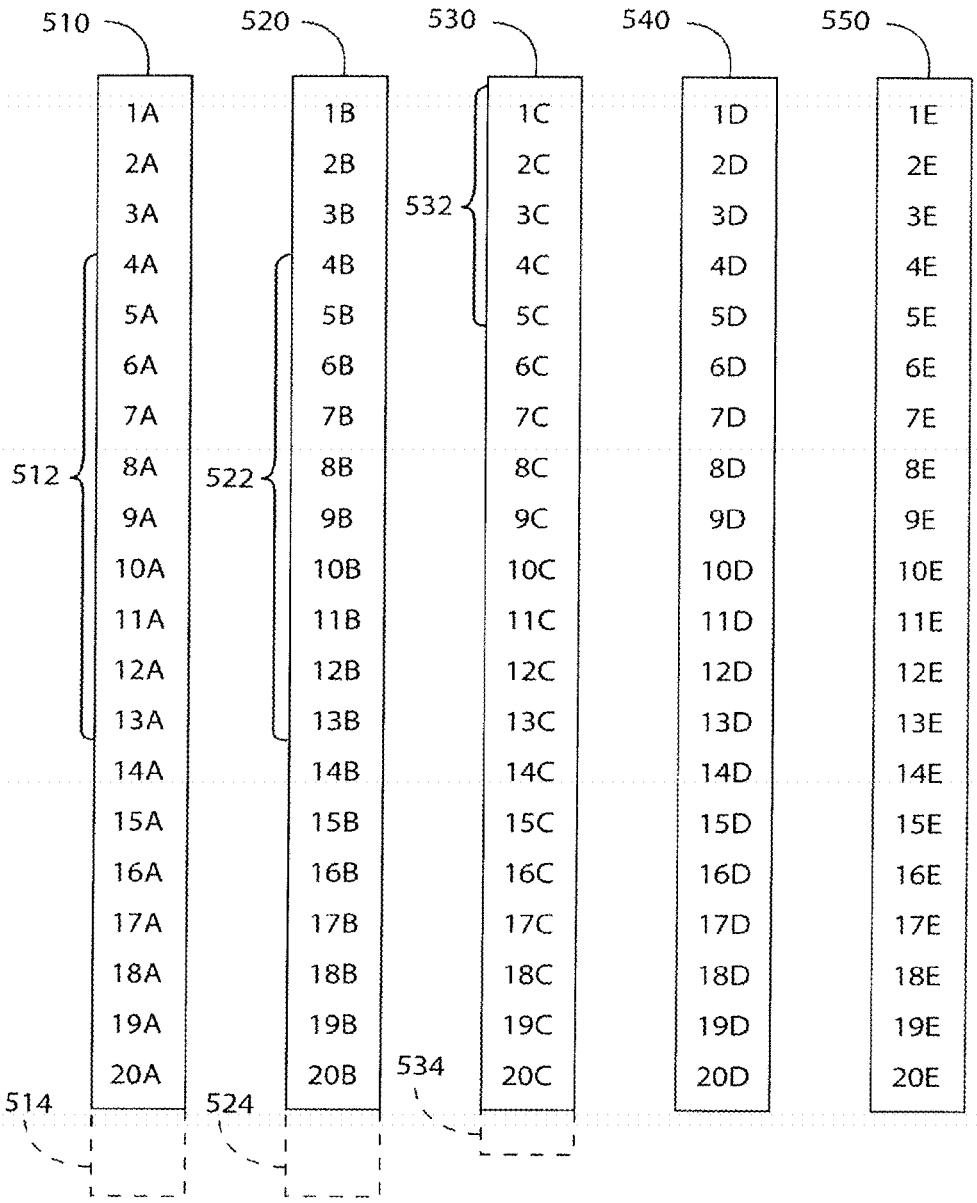
FIG. 6 is a schematic illustration of an exemplary wagering game with randomized clumping of symbols in accordance with embodiments of the present disclosure.

Referring now to FIG. 6, an exemplary wagering game 500 is shown in accordance with embodiments of the present disclosure. The wagering game 500 can be played, for example, on the gaming terminal 10 of FIG. 1A, the handheld gaming device 110 of FIG. 1B, the gaming system illustrated in FIG. 2, or any other recognized gaming apparatus capable of executing the necessary content of the wagering game 500. The exemplary wagering game 500 is illustrated in FIG. 6 as a slot-type wagering game, which includes a plurality of symbol-bearing reels, represented herein by five reel strips 510, 520, 530, 540 and 550, respectively, which may be electro-mechanical reels, simulations of mechanical reels, or any variation thereof. Each of the reels 510, 520, 530, 540, 550 has a plurality of distinct symbol positions. In the illustrated embodiment, for example, the first reel 510 has 20 individual symbol positions, which are respectively designated as positions 1A-20A; the second reel 520 also has 20 individual symbol positions, which are respectively designated as positions 1B-20B; the third reel 530 has 20 individual symbol positions, which are respectively designated as positions 1C-20C; the fourth reel 540 has 20 individual symbol positions, which are respectively designated as positions 1D-20D; and the fifth reel 550 has 20 individual symbol positions, which are respectively designated as positions 1E-20E. Recognizably, the wagering game 500 may be comprised of fewer or greater than five reels. Moreover, the reels may be individually or collectively varied to comprise fewer or greater than 20 symbol positions without departing from the scope and spirit of the present disclosure.

Figure 4:
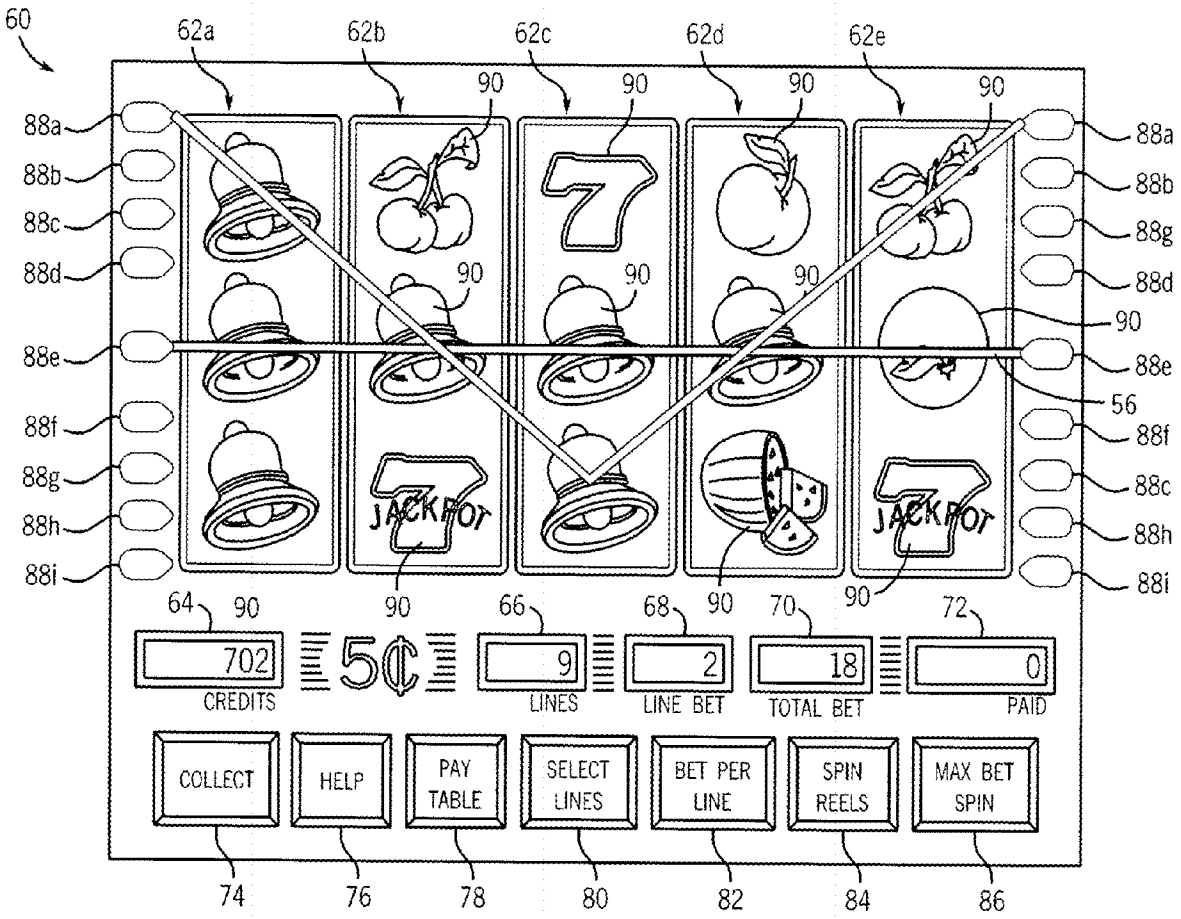
FIG. 4 is a screen shot of the exemplary wagering game from FIG. 3 showing an exemplary symbol clamp that has been added to one of the symbol-bearing reels.

Each of the reels 510, 520, 530, 540, 550 bears an array of symbols, each of which, in the illustrated embodiment, occupies at least one symbol position. The symbols may include any variety of graphical symbols, emblems, elements, or representations, including symbols that are associated with one or more game themes, for example, of the gaming terminal or system. The symbols may also include a blank symbol or empty space. In general, each symbol position on each reel is occupied by a single symbol or a blank. Some of the symbols in the wagering game 500 of FIG. 6 may be grouped into a corresponding clump of symbols. The term "clump" or "symbol clump" refers to a single type of symbol occupying two or more symbol positions that are located immediately adjacent one another on a single reel. By way of example, and not limitation, a symbol clump can consist of three "bell" symbols occupying three adjacent symbol positions on the a single reel, as seen for example on reel 62*a* in FIG. 4. Alternatively, a symbol clump can consist of single elongated or enlarged "cherry"

symbol that occupies symbol positions 4A, 5A and 6A on the first reel 510. In yet a further alternate arrangement, a clump may comprise one or more elongated/enlarged symbols in combination with one or more standard-sized symbols that occupy numerous symbol positions that are all immediately adjacent one another on a single reel. In some embodiments, each of the symbol clumps is evaluated as a unitary element in determining whether the outcome represents a winning outcome. By occupying multiple symbol positions with one or more of the same symbols, a symbol clump typically increases the likelihood of achieving that particular winning outcome and corresponding award, as seen for example in FIG. 4.

With continuing reference to FIG. 6, the reels 510, 520, 530, 540, 550 are generally employed to visually indicate randomly selected wagering-game outcomes to a player. For example, a controller, whether resident to the gaming device or part of a central server of a gaming network, uses a random number generator (RNG) to randomly generate a wagering-game outcome from a plurality of possible outcomes. The reels 510, 520, 530, 540, 550 are varied, which is typically visually indicated to players by spinning and stopping the reels, to reveal combinations of symbols. These revealed combinations of symbols represent the randomly selected outcomes of the wagering game 500, which are evaluated for winning combinations. For instance, the randomly selected outcomes may comprise a pre-selected number of symbols positions from each reel 510, 520, 530, 540, 550 being arranged in and revealed as a matrix, similar to the 3×5 matrix of symbols shown on the screen 60 in FIG. 3. In alternate embodiments, the matrix of symbols may have greater or fewer than 15 symbols, and may take on a variety of different forms having greater or fewer rows and/or columns. In other embodiments, the symbols are revealed as a non-rectangular array of symbols. Winning combinations of symbols landing, for example, on activated paylines (e.g., those paylines for which a wager has been received), cause awards to be paid in accordance with one or more paytables associated with the wagering game 500. In some embodiments, winning combinations of symbols include three or more like symbols adjacent one another on an active pay line (e.g., left-to-right configuration, right-to-left configuration, or both). In some embodiments, symbol combinations are evaluated in accord with various other schemes such as, but not limited to, scatter pays.

The exemplary wagering game 500 of FIG. 6 includes a randomized-clumping-of-symbols feature in accordance with embodiments of the present disclosure. According to one aspect of the randomized-clumping-of-symbols feature, prior to displaying the outcome of each play of the wagering game 500 via a display device, such as the primary or secondary displays 14, 16 of FIG. 1, it is determined, for example, via controller 42 whether to add at least one symbol clump to at least one of the reels 510, 520, 530, 540, 550. In some aspects, it is randomly determined, on a reel-by-reel basis, whether to add one or more symbol clumps to each of the reels 510, 520, 530, 540, 550 in the wagering game 500. Additionally, or as an alternative thereto, the determination of whether to add a symbol clump to a reel is made on a symbol-location-by-symbol-location basis. According to one optional configuration, for example, it is first determined whether the first symbol position 1A on the first reel strip 510 in the wagering game 500 will be part of a clump. If not, the determination sequence moves to the second symbol position 2A on the first reel strip 510 and makes a corresponding determination. However, if it is determined that the first symbol position 1A will be part of a clump, the length of the clump is then determined, as described in various alternative forms below. In this instance, the clump length will determine how many symbol positions subsequent to the first symbol position 1A will be part of the clump. By way of example, and not limitation, if it is determined that a clump is to be added to the first reel strip 510 starting at the first symbol position 1A, and it is contemporaneously determined that the clump size is 6 symbol positions long, then the second through sixth symbol positions 2A-6A are automatically converted, in one embodiment, from their initial symbol to a clumped symbol. For example, the symbol associated with symbol position 1A may be replicated into each of the symbol positions 2A through 6A, respectively, to form the determined six-symbol clump.

According to one embodiment, there is no individualized determination whether the second through sixth symbol positions 2A-6A will be part of a clump. In this embodiment, the above clump-determination sequence is repeated through each of the remaining symbol positions 7A-20A on the first reel 510, and continues in a similar manner for each of the symbol positions on the remaining reels 520, 530, 540, 550. In an alternative embodiment, a clump determination can be made for each symbol position, regardless of whether the symbol position was already determined to be part of a clump. In this embodiment, a latter clump determination could override a prior clump determination for the associated symbols and the particular reel would end up with two adjacent clumps (generally of a different symbol type).

Although it is often desirable that the execution of the aforementioned determination sequence be systematic (e.g., executed during every play, during every other play, etc.), the determination itself is random and arbitrary in some embodiments. In various aspects, the determination of whether to add one or more symbol clumps to one or more of the reels is prior to evaluating the wagering-game outcome to determine if the wagering-game outcome includes at least one winning outcome (e.g., a winning symbol combination). The determination of whether to add a symbol clump is, in some configurations, substantially contemporaneous with the random determination of the wagering-game outcome. In yet other embodiments, the determination of whether to add one or more symbol clumps to one or more of the reels is prior to the random determination of the wagering-game outcome.

According to some aspects of the present concepts, determining whether or not to add a symbol clump to the wagering game 500 includes conducting a separate random determination sequence for each of the reels 510, 520, 530, 540, 550. By way of illustration, and not limitation, a first random determination determines whether to add at least one symbol clump to the first reel 510, and a second random determination determines whether to add at least one symbol clump to the second reel 520. This may be extended to include conducting a third random determination of whether to add at least one symbol clump to the third reel 530, conducting a fourth random determination of whether to add at least one symbol clump to the fourth reel 540, and conducting a fifth random determination of whether to add at least one symbol clump to fifth third reel 530. Alternatively, the random determination sequences for the reels 510, 520, 530, 540, 550 can be linked. For instance, determining whether or not to add a symbol clump to the wagering game 500 includes conducting a first random determination of whether to add at least one symbol clump to a first set of reels (e.g., the first, third and fifth reels 510, 530, 550), and conducting a second random determination of whether to add at least one symbol clump to a second set of reels (e.g., the second and fourth reels 520, 540).

According to some aspects of the present concepts, the probability of each reel being assigned a symbol clump is the same. In an alternate embodiment, the probability of each reel being assigned a symbol clump varies from reel to reel. By way of clarification, in the example set forth above, the probability of the first random determination adding at least one symbol clump to the first reel 510 is different than the probability of the second random determination adding at least one symbol clump to the second reel 520, which is different than the probability of the third random determination adding at least one symbol clump to the third reel 530, and so forth. In yet another alternate embodiment, the probability of each reel being assigned a symbol clump can be varied from reel set to reel set. For instance, the probability of the first random determination adding at least one symbol clump to the first set of reels (e.g., the first, third and fifth reels 510, 530, 550) can be different than the probability of the second random determination adding at least one symbol clump to the second set of reels (e.g., the second and fourth reels 520, 540). Moreover, the probability of any given reel being assigned a clump can be varied based on, for example, the size of the wager for that particular play of the wagering game 500, the total coin-in up until that particular play of the wagering game 500, the particular player engaging in that particular play of the wagering game 500, or other metrics related to or unrelated to the wagering game 500. In one optional arrangement, the probability of a reel being assigned a symbol clump, being assigned a larger clump, being assigned a clump consisting of high-payout symbols, or any combination thereof, can increase or decrease from the left-most, first reel 510 to the right-most, last reel 550.

Responsive to a determination to add one or more symbol clumps to one or more of the reels 510, 520, 530, 540, 550 in the wagering game 500, some embodiments include determining one or more characteristics of the added symbol clump. The characteristics of the at least one symbol clump may include the clump's size, the clump's location, a clump area, which is explained in further detail below, the symbol(s) that will make up the clump, or any combination thereof. In one non-limiting example, where it is determined that a clump or array of clumps will be added to a respective reel, it is then determined what is the size (i.e., number of symbol positions) of each clump. The clump size may be randomly designated (e.g., anywhere between two symbol positions and the total number of symbol positions on the respective reel), may be designated in accordance with a weighted table (e.g., the weighted table indicates that the next 10 symbols are to be clumped with the same symbol), may be designated within a predetermined range (e.g., 2-10 symbol positions), or may be selected from a group of predetermined clump lengths (e.g., 2, 3, 5 or 7 symbol positions), or any logical combination thereof. Alternatively, the size of an added clump may be predetermined (e.g., all clumps added to the first reel 510 will be comprised of two symbol positions, all clumps added to the second reel 520 will be comprised of three symbol positions, all clumps added to the third reel 530 will be comprised of four symbol positions, etc.). In yet another optional configuration, the characteristics of all added clumps (e.g., size, location, symbol, etc.) can be fixed and unchangeable.

In another non-limiting example of determining clump characteristics, it can also be determined, in instances where a clump will be added to a reel, the location on that particular reel (i.e., what symbol positions) at which the clump will be placed (i.e., the clump's location). According to various aspects, each clump is assigned to a random location along a respective reel. For instance, if a symbol clump comprised of four symbol locations is to be added to the fourth reel 540, the symbol clump can be randomly assigned to symbol positions 1D-4D, 2D-5D, or 3D-6D and so on up to 17D-20D, and even overlap from 18D-1D, or 19D-2D, and so on.

In an alternate embodiment, one or more of the reels 510, 520, 530, 540, 550 have a designated clump area comprised of preselected ones of the symbol positions. If a reel has a designated clump area, some embodiments require the addition of any symbol clump be to that designated clump area. In FIG. 6, for example, the first reel strip 510 has a first designated clump area 512 that consists of symbol positions 4A-13A. Likewise, the second reel strip 520 has a second designated clump area 522 that consists of symbol positions 4B-13B. In some embodiments, all of the remaining reel strips will have analogous designated clump areas. Alternatively, one or more of the reel strips can have different designated clump areas. The third reel strip 530 of FIG. 6, for example, is illustrated with a third designated clump area 532 that consists of symbol positions 1C-5C. This example also illustrates that not only the location, but also the size of a respective designated clump area can be varied. Another optional arrangement includes providing some of the reel strips with a respective designated clump area, but not all of the reel strips. By way of illustration, the first, second and third reels 510, 520, 530 are each shown in FIG. 6 with a respective designated clump area 512, 522, 532, as described above; however, the fourth and fifth reels 540, 550 are shown without a designated clump area. In this instance, the wagering game 500 could be modified such that the fourth and fifth reels 540, 550 cannot have a clump randomly assigned thereto. Alternatively, the wagering game 500 could be modified such that the addition of a clump, if any, to the fourth and fifth reels 540, 550 is placed at random, as described above. Any combination or obvious variation of the foregoing features is also contemplated as being within the scope and spirit of the present disclosure.

In some embodiments where a symbol clump is being added to a reel with a designated clump area, the symbol clump is added to and must fit within the designated clump area. If the number of symbol positions occupied by the clump (i.e., the clump size) is equal to the number of symbol positions in the designated clump area, the entire designated clump area is filled with the added clump. For instance, if it is determined that a clump is to be added to the third reel 530 in FIG. 6, and the size of the clump is five symbol positions, then the entire third designated clump area 532 would be filled by the added clump. If, however, the clump size is less than the number of symbol positions in the designated clump area, the remaining "unfilled" symbol positions (i.e., those symbol positions that are not occupied by the added symbol clump) may then need to be filled.

Continuing with the above example, the symbol positions 1C-5C on the third reel 530 may be otherwise without symbols. If a clump consisting of three symbol positions is added to the third designated clump area 532, whereby symbol positions 3C-5C are occupied, for example, the first two symbol positions 1C and 2C on the third reel 530 would each remain "empty"—i.e., without a designated symbol occupying that position. Under these circumstances, the controller can responsively fill the empty symbol positions. In some configurations, the controller randomly assigns a symbol to each empty symbol position until the entire designated clump area is filled with clump(s) and symbol(s). Alternatively, the empty symbol positions can be automatically filled with predetermined symbols (e.g., all empty symbol positions are filled with a cherry symbol, a bell symbol, another symbol, or any variation thereof). In yet another optional configuration, each symbol position within a designated clump area may already be occupied by a predesignated symbol. In this example, the addition of any clump to a designated clump area would merely replace or temporarily substitute for the symbols occupying the symbol locations to which the clump is added. Thus, there are no "empty" or unfilled symbol positions in the designated clump area requiring symbols be added thereto.

In some embodiments of the present disclosure, each of the reels 510, 520, 530, 540, 550 in the wagering game 500 has an initial length. As explained above, each of the reels 510, 520, 530, 540, 550 in the exemplary arrangement illustrated in FIG. 6 is initially comprised of 20 distinct symbol positions. Various aspects of the present disclosure include increasing the initial length of a reel in response to a determination to add one or more symbol clumps to that reel to accommodate the addition of the symbol clump(s). For instance, if a clump/group of clumps is being added to the first reel 510, and the clump/clumps occupy a total of 10 symbol positions, the first reel 510 can be expanded to have a first modified length 514 of 30 symbol positions. Likewise, if a clump/group of clumps is being added to the second reel 520, and the added clump/clumps occupy a total of 12 symbol positions, the second reel 520 can be expanded to have a second modified length 524 of 32 symbol positions.

Optionally, the length of a reel strip can be modified such that the overall volatility of the wagering game is maintained. For instance, if a clump consisting of five high-payout symbols is being added to the third reel 530, the third reel 530 can be expanded to have a third modified length 534 of n symbol positions, where n is the number of symbol positions necessary to offset the addition of a clump consisting of five high-payout symbols to thereby maintain a predetermined volatility in the wagering game 500. According to another optional configuration, the length of a reel strip can be decreased. By way of clarification, and not limitation, in the examples set forth above with respect to a designated clump area that is not completely filled by an added clump, rather than filling any or all of the "empty" symbol positions, the length of the reel can be reduced to eliminate some or all of the "empty" symbol positions.

Once a determination is made to add one or more symbol clumps to one or more of the reels 510, 520, 530, 540, 550 in the wagering game 500, some embodiments include visually indicating the addition of the symbol clump(s) to the reel(s). In general, the determination of whether to add at least one symbol clump to at least one of the reels 510, 520, 530, 540, 550 is prior to displaying the outcome of each play of the wagering game 500 via a display device. As noted above, the combinations of symbols revealed after varying (e.g., spinning and stopping) the reels 510, 520, 530, 540, 550 typically represent the randomly selected outcomes of the wagering game 500. Thus, in some aspects, the addition of the symbol clump(s) to the reel(s) is visually indicated to the player while the reels are spinning. The addition can be visually indicated by filling the symbol clumps with identical symbols (i.e., same color, shape, content, etc.) such that when the reels are spinning the player can see the addition of the clump by the change from a constant blur (e.g., little or no visual delineation) of mostly different symbols on the reel(s) to a more readily distinct (e.g., visually delineable) "clumping" of similar symbols on the reel(s). An advantage to the randomized-clumping-of-symbols feature is that the player is provided a visual indication or a "clue" that the reels are changing from play-to-play in a manner that may be more beneficial to the player. For instance, by occupying multiple symbol positions with one or more of the same symbols, a symbol clump typically increases the likelihood of achieving a winning outcome and corresponding award, as seen for example in FIG. 4. Consequently, the player's anticipation and expectation of winning builds during the spinning of the reels. In a conventional slot machine, it is generally difficult to differentiate between symbols when the reels are in motion. However, by employing any/all of the foregoing features, a player will see that a distinguishable section or sections of a spinning reel or set of reels have been "clumped" with the same symbols (e.g., all the same color/pattern/animation, etc.).

In accordance with other aspects of the present concepts, prior to displaying the outcome of each play of the wagering game 500, it may be determined whether to add one or more pattern clumps to one or more of the reels 510, 520, 530, 540, 550. A "pattern clump," as used herein, replicates one or more symbols into other symbol positions on a reel according to a predetermined or randomized pattern—thus increasing the probability that the replicated symbol be displayed as part of the final outcome. For example, a pattern clump may include multiple symbol positions with every other symbol position including a Wild symbol, or every third symbol position including a bonus symbol for part or the entire reel strip. Similar to the above-described symbol clump, a pattern clump can be used to provide excitement to the player by visually indicating that a particular clump has been selected as the reels spin, and increasing the probability that that particular symbol combination will be achieved as part of the wagering-game outcome. However, by using a pattern clump, as opposed to a symbol clump, the number of clumped symbols in the final outcome can be better controlled (e.g., in a 3×5 array, with a pattern clump selected to replicate a symbol every three symbol positions, the wagering game ensures that only a single one of the replicated clumped symbols will be available on any particular reel as part of the final outcome). Similarly, the pattern clump may be utilized to ensure that the selected clump is more easily noticed, visually, by the player on every spin or to ensure that at least one of the selected symbol will be a part of the final outcome for that particular spin.

Figure 7:
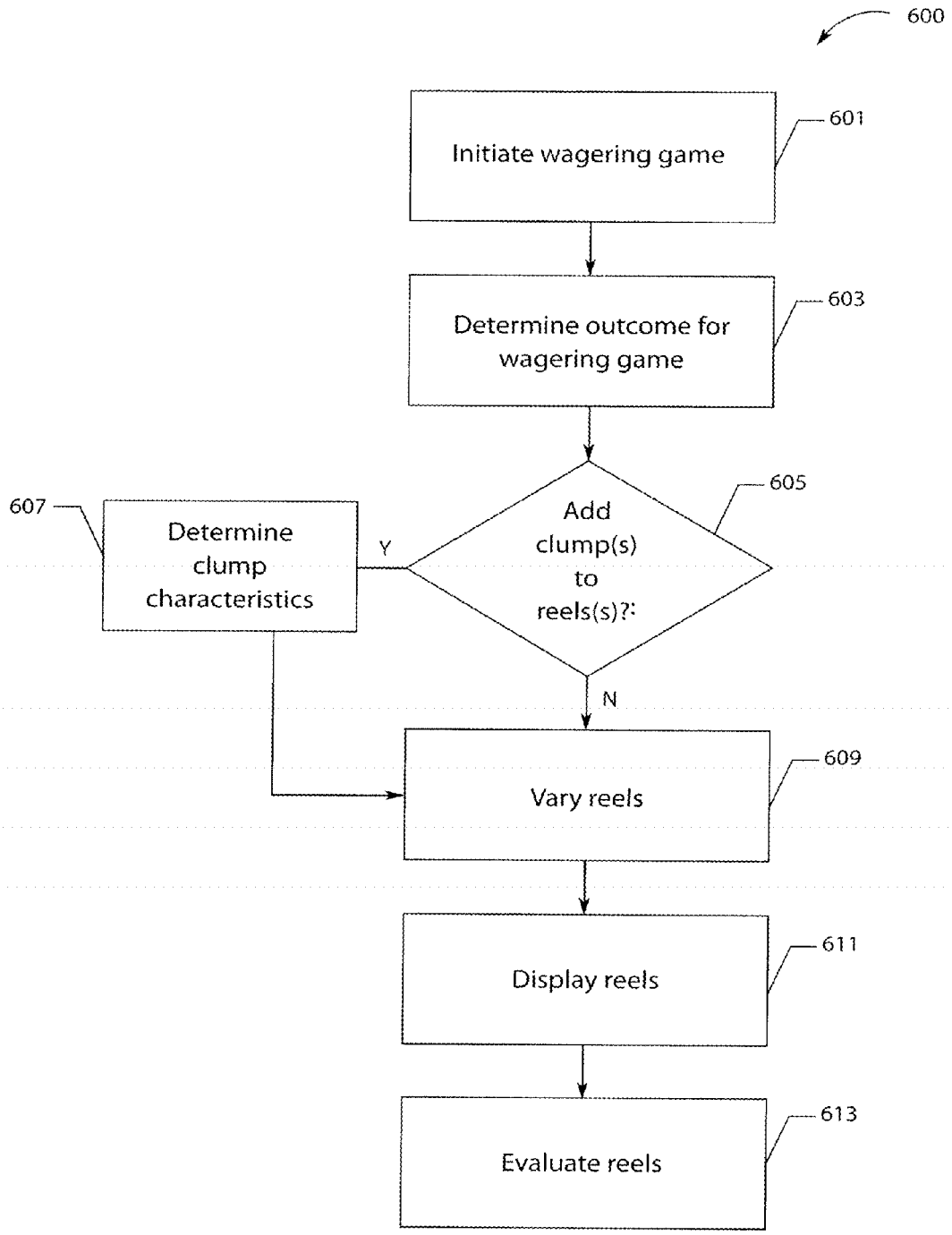
FIG. 7 is a flowchart for an exemplary method or algorithm that corresponds to instructions that can be executed by a controller in accord with at least some aspects of the disclosed concepts.

Recognizably, when the reels are randomly spun and stopped, the added symbol clumps may or may not be displayed as part of the wagering-game outcome. In another optional arrangement, where the wagering game has entered a free-spin bonus game, where a reel/number of reels have been assigned a clump/array of clumps, for each subsequent spin, an additional symbol position is assigned to one or more or all of the clumps FIG. 7 represents an algorithm that corresponds to at least some instructions that can be executed, for example, by the controller 42 and/or external systems 46 in FIG. 2 to perform any or all of the above described functions and features associated with the disclosed concepts. By way of non-limiting example, the exemplary algorithm 600 of FIG. 7 includes, at block 601, initiating a wagering game, for example, using CPU/controller 42 of FIG. 2. The wagering game, such as those wagering games discussed above with respect to FIGS. 3 and 5, includes a plurality of reels, such as reels 510, 520, 530, 540, 550 of FIG. 6, each of which has a plurality of distinct symbol positions and bears a variety of symbols.

At block 603, the exemplary method 600 includes determining (e.g., via controller 42 of FIG. 2) an outcome of the wagering game. The wagering-game outcome is randomly determined from a plurality of wagering-game outcomes, for example, using a random number generator (RNG) in the manner disclosed above. One or more of the plurality of wagering-game outcomes constitutes a winning outcome for which a corresponding award is conferred upon the player. In addition or as an alternative to the foregoing, block 603 may comprise determining the stop position(s) for the reels in the array.

Prior to displaying the outcome of the wagering game, it is determined at block 605 whether to add one or more symbol clumps to one or more of the reels in the wagering game. The foregoing determination can be made, for example, on a reel-by-reel basis, a symbol location-by-symbol location basis, a reel set-by-reel set, collectively for all of the reels, or any logical variation and combination thereof. In some embodiments, the determination itself is random. Moreover, the determination sequence at block 605 can be conducted prior to, during, or after the initiating the wagering game at block 601. Likewise, the determination sequence at block 605 can be conducted prior to, during, or after the determining the wagering-game outcome at block 603. In some embodiments, the determination of whether to add one or more symbol clumps to one or more of the reels at block 605 is prior to evaluating the wagering-game outcome to determine if the wagering-game outcome includes at least one winning outcome. If the determination at block 605 is to not add a symbol clump (i.e., block 605=NO), the method 600 proceeds to block 609 without adding any clumps to any of the reels prior to displaying the wagering-game outcome.

Responsive to a determination to add a symbol clump to one of the plurality of reels in the wagering game (i.e., block 605=YES), block 607 includes determining one or more characteristics of each added symbol clump. As noted above, these clump characteristics can include, but are not limited to, the clump's size, the clump's location, a designated clump area to which the clump will be added, the symbol(s) which will make up the clump, or any combination thereof. Recognizably, the clump characteristics of one or more of the added clumps will be predetermined and, thus, block 607 may be omitted in some embodiments. In determining the clump characteristics at block 607, the reel to which the clump will be added may need to be modified to accommodate the added clump, for example, as described above with respect to the modifying the initial reel lengths and/or varying the content of the designated clump areas.

Once the clump characteristics are determined at block 607, the reels are displayed as spinning and stopping at block 609. As noted above, some embodiments of the present disclosure visually indicate the addition of the symbol clump(s) to the player while the reels are spinning. Alternatively, the addition of any symbol clumps to the reels can be visually indicated prior to or after the spinning of the reels. At block 611, the wagering-game outcome is displayed to the player, e.g., via the primary display area 14 and/or secondary display area 16 of FIG. 1*a*, and evaluated for winning outcomes at block 613. Recognizably, the evaluation of the reels for winning outcomes, as set forth in block 613, can be performed prior to displaying the wagering-game outcome at block 611 (e.g., substantially contemporaneously with the determination of the wagering-game outcome at block 603).

In some embodiments, the method 600 includes at least those steps enumerated above. It is also within the scope and spirit of the present disclosure to omit steps, include additional steps, and/or modify the order presented in FIG. 7. It should be further noted that the method represents a single execution of a gaming feature while conducting a wagering game for a player. However, it is expected, as indicated above, that the method be applied in a systematic and repetitive manner.

While many preferred embodiments and best modes for carrying out the present invention have been described in detail above, those familiar with the art to which this invention relates will recognize various alternative designs and embodiments for practicing the invention within the scope of the appended claims.

What is claimed is:

1. A gaming system, comprising:

a gaming machine for playing at least one casino wagering game, the gaming machine including an electronic display device and one or more electronic input devices, the electronic display device configured to display a plurality of symbol-bearing reels each having a plurality of symbol positions occupied by symbols, at least one first reel of the plurality of symbol-bearing reels having a designated clump area comprising a predetermined number of symbol positions of the plurality of symbol positions of the at least one first reel; and game-logic circuitry configured to:

detect, via at least one of the one or more electronic input devices, a physical item associated with a monetary value that establishes a credit balance;

initiate a casino wagering game of the at least one casino wagering game in response to an input indicative of a wager covered by the credit balance;

prior to determining a stopping position of any of the plurality of symbol-bearing reels, randomly determine whether to include a symbol clump in the designated clump area, the symbol clump comprising a plurality of identical symbols occupying adjacent ones of the symbol positions within the designated clump area and, responsive to a determination to add the symbol clump in the designated clump area, add the symbol clump in the designated clump area prior to determining the stopping position of any of the plurality of symbol-bearing reels;

direct the electronic display device to display the plurality of symbol-bearing reels spinning and stopping to present an outcome of the casino wagering game; and receive, via at least one of the one or more electronic input devices, a cashout input that initiates a payout from the credit balance.

2. The gaming system of claim 1, wherein in response to randomly determining that the symbol clump is not to be included in the designated clump area, the game-logic circuitry is configured to include a mixture of different symbols in the designated clump area.

3. The gaming system of claim 2, wherein the symbols in the mixture of different symbols included in the designated clump area are at least one of randomly determined or predetermined.

4. The gaming system of claim 1, wherein randomly determining whether to include the symbol clump in the designated clump area comprises conducting, on a reel-by-reel basis for the plurality of symbol-bearing reels, a respective random determination of whether to add a respective symbol clump to the designated clump area for the respective symbol-bearing reel.

5. The gaming system of claim 1, wherein the game-logic circuitry is further configured to randomly determine at least one of a size or a location of a second symbol clump for at least one second reel of the plurality of symbol-bearing reels not having the designated clump area.

6. A method of operating a gaming system, the gaming system including game-logic circuitry and a gaming machine, the gaming machine configured to conduct at least one casino wagering game, the gaming machine including one or more electronic display devices and one or more electronic input devices, a casino wagering game of the at least one casino wagering game including a plurality of symbol-bearing reels each having symbol positions occupied by symbols, at least one of the one or more electronic display devices being configured to display the plurality of symbol-bearing reels spinning and stopping to reveal an outcome of the casino wagering game, at least one first reel of the plurality of symbol-bearing reels having a designated clump area comprising a predetermined number of the symbol positions of the at least one first reel, the method comprising:

detecting, via at least one of the one or more electronic input devices of the gaming machine, a physical item associated with a monetary value that establishes a credit balance;

initiating, via the game-logic circuitry, the casino wagering game in response to a wager input indicative of a wager covered by the credit balance;

displaying, via at least one of the one or more electronic display devices, the plurality of symbol-bearing reels spinning;

prior to determining a stopping position of any of the plurality of symbol-bearing reels, randomly determining whether to include a symbol clump in the designated clump area of the at least one first reel, the symbol clump comprising a plurality of identical symbols occupying adjacent ones of the symbol positions within the designated clump area;

responsive to determining to add the symbol clump to the at least one first reel, adding the symbol clump to the designated clump area of the at least one first reel prior to determining a stopping position of any of the plurality of symbol-bearing reels;

displaying, via at least one of the one or more electronic display devices, the plurality of symbol-bearing reels stopping to reveal the outcome of the casino wagering game; and receiving, via at least one of the one or more electronic input devices, a cashout input that initiates a payout from the credit balance.

7. The method of claim 6, wherein in response to randomly determining that the symbol clump is not to be included in the designated clump area, the method further comprises including a mixture of different symbols in the designated clump area.

8. The method of claim 7, wherein the symbols in the mixture of different symbols included in the designated clump area are at least one of randomly determined or predetermined.

9. The method of claim 6, wherein randomly determining whether to include the symbol clump in the designated clump area comprises conducting, on a reel-by-reel basis for the plurality of symbol-bearing reels, a respective random determination of whether to add a respective symbol clump to the designated clump area for the respective symbol-bearing reel of the plurality of symbol-bearing reels.

10. A gaming system, comprising:

a gaming machine for playing at least one casino wagering game, the gaming machine including an electronic display device and one or more electronic input devices, the electronic display device configured to display a plurality of symbol-bearing reels each having a plurality of symbol positions occupied by symbols, at least one first reel of the plurality of symbol-bearing reels having a designated clump area comprising a predetermined number of the symbol positions of the at least one first reel; and game-logic circuitry configured to:

detect, via at least one of the one or more electronic input devices, a physical item associated with a monetary value that establishes a credit balance;

initiate a casino wagering game of the at least one casino wagering game in response to an input indicative of a wager covered by the credit balance;

prior to determining a stopping position of any of the plurality of symbol-bearing reels randomly determine whether to include a symbol clump, a mixture of different symbols, or a combination thereof in the designated clump area, the symbol clump comprising a plurality of identical symbols occupying adjacent ones of the symbol positions within the designated clump area and, responsive to determining to add the symbol clump, the mixture of different symbols, or the combination thereof to the designated clump area, add the symbol clump, the mixture of different symbols, or the combination thereof in the designated clump area;

direct the electronic display device to display the plurality of symbol-bearing reels spinning and stopping to present an outcome of the casino wagering game; and receive, via at least one of the one or more electronic input devices, a cashout input that initiates a payout from the credit balance.

11. The gaming system of claim 10, wherein in response to randomly determining that the symbol clump is not to be included in the designated clump area, the game-logic circuitry is configured to include the mixture of different symbols in the designated clump area.

12. The gaming system of claim 11, wherein the symbols in the mixture of different symbols included in the designated clump area are at least one of randomly determined or predetermined.

13. The gaming system of claim 10, wherein randomly determining whether to include the symbol clump, the mixture of different symbols, or the combination thereof in the designated clump area comprises conducting, on a reel-by-reel basis for the plurality of symbol-bearing reels, a respective random determination as to each respective symbol-bearing reel of the plurality of symbol-bearing reels.

14. The gaming system of claim 10, wherein the game-logic circuitry is further configured to randomly determine at least one of a size or a location of a second symbol clump for at least one second reel of the plurality of symbol-bearing reels not having a designated clump area.

15. A method of operating a gaming system, the gaming system including game-logic circuitry and a gaming machine configured to conduct at least one casino wagering game, the gaming machine including one or more electronic display devices and one or more electronic input devices, a casino wagering game of the at least one casino wagering game including a plurality of symbol-bearing reels each having symbol positions occupied by symbols, at least one of the one or more electronic display devices being configured to display the plurality of symbol-bearing reels spinning and stopping to reveal an outcome of the casino wagering game, at least one first reel of the plurality of symbol-bearing reels having a designated clump area comprising a predetermined number of the symbol positions of the at least one first reel, the method comprising:

detecting, via at least one of the one or more electronic input devices of the gaming machine, a physical item associated with a monetary value that establishes a credit balance;

initiating, via the game-logic circuitry, the casino wagering game in response to a wager input indicative of a wager covered by the credit balance;

displaying, via at least one of the one or more electronic display devices, the plurality of symbol-bearing reels spinning;

prior to determining a stopping position of any of the plurality of symbol-bearing reels, randomly determining whether to include a symbol clump, a mixture of different symbols, or a combination thereof in the designated clump area, the symbol clump comprising a plurality of identical symbols occupying adjacent ones of the symbol positions within the designated clump area;

responsive to the random determination to include the symbol clump, the mixture of different symbols, or the combination thereof in the designated clump area of the at least one first reel, adding the symbol clump, the mixture of different symbols, or combination thereof, to the designated clump area of the at least one first reel prior to determining the stopping position for any of the plurality of symbol-bearing reels;

displaying, via at least one of the one or more electronic display devices, the plurality of symbol-bearing reels stopping to reveal the outcome of the casino wagering game; and receiving, via at least one of the one or more electronic input devices, a cashout input that initiates a payout from the credit balance.

16. The method of claim 15, wherein the symbols in the mixture of different symbols included in the designated clump area are at least one of randomly determined or predetermined.

17. The method of claim 15, wherein randomly determining whether to include the symbol clump in the designated clump area comprises conducting, on a reel-by-reel basis for the plurality of symbol-bearing reels, a respective random determination of whether to add a respective symbol clump, mixture of different symbols, or combination thereof to the designated clump area for the respective symbol-bearing reel.

18. The method of claim 15, wherein the method further comprises randomly determining at least one of a size or a location of a second symbol clump, the mixture of different symbols, or the combination thereof for at least one second reel of the plurality of symbol-bearing reels not having the designated clump area.

19. A gaming system, comprising:

a gaming machine for playing at least one casino wagering game, the gaming machine including an electronic display device and one or more electronic input devices, the electronic display device configured to display a plurality of symbol-bearing reels each having a plurality of symbol positions occupied by symbols, at least one first reel of the plurality of symbol-bearing reels having a symbol clump comprising a plurality of identical symbols occupying adjacent ones of the symbol positions; and game-logic circuitry configured to:

detect, via at least one of the one or more electronic input devices, a physical item associated with a monetary value that establishes a credit balance;

initiate a casino wagering game of the at least one casino wagering game in response to an input indicative of a wager covered by the credit balance;

prior to determining a stopping position of any of the plurality of symbol-bearing reels, randomly determine at least one of a size or a location of the symbol clump on the at least one first reel;

direct the electronic display device to display the plurality of symbol-bearing reels spinning and stopping to present an outcome of the casino wagering game; and receive, via at least one of the one or more electronic input devices, a cashout input that initiates a payout from the credit balance.

20. The gaming system of claim 19, wherein the random determination of at least one of the size or the location of the symbol clump on the at least one of first reel is made prior to randomly determining the outcome of the casino wagering game.

21. The gaming system of claim 19, wherein the random determination of at least one of the size or the location of the symbol clump includes conducting, on a reel-by-reel basis, a respective random determination of at least one of a respective size or a respective location of the symbol clump within each of the at least one first reel.

22. The gaming system of claim 19, wherein a first probability of a first one of the random determinations on the reel-by-reel basis as to at least one of the size or the location of the symbol clump for a first one of the plurality of symbol-bearing reels is different than a second probability of a second one of the random determinations on the reel-by-reel basis of as to at least one of the size or the location of the symbol clump for a second one of the plurality of symbol-bearing reels.

23. A method of operating a gaming system, the gaming system including game-logic circuitry and a gaming machine configured to conduct at least one casino wagering game, the gaming machine including one or more electronic display devices and one or more electronic input devices, a casino wagering game of the at least one casino wagering game including a plurality of symbol-bearing reels each having symbol positions occupied by symbols, at least one of the one or more electronic display devices being configured to display the plurality of symbol-bearing reels spinning and stopping to reveal an outcome of the casino wagering game, at least one clump reel of the plurality of symbol-bearing reels having a symbol clump comprising a plurality of identical symbols occupying adjacent ones of the symbol positions of the at least one clump reel, the method comprising:

detecting, via at least one of the one or more electronic input devices of the gaming machine, a physical item associated with a monetary value that establishes a credit balance;

initiating, via the game-logic circuitry, the casino wagering game in response to a wager input indicative of a wager covered by the credit balance;

displaying, via at least one of the one or more electronic display devices, the plurality of symbol-bearing reels spinning;

prior to determining a stopping position of any of the plurality of symbol-bearing reels, randomly determining at least one of a size or a location of the symbol clump on the at least one clump reel of the plurality of symbol-bearing reels;

displaying, via at least one of the one or more electronic display devices, the plurality of symbol-bearing reels stopping to reveal the outcome of the casino wagering game; and receiving, via at least one of the one or more electronic input devices, a cashout input that initiates a payout from the credit balance.

24. The method of claim 23, wherein randomly determining at least one of the size or the location of the symbol clump comprises conducting, on a reel-by-reel basis for the plurality of symbol-bearing reels, a respective random determination for each symbol-bearing reel.

25. The method of claim 23, wherein the at least one clump reel includes a first reel and a second reel, the first reel including a first symbol clump having a first size and the second reel including a second symbol clump having a second size different than the first size.

26. The method of claim 23, wherein a probability of a first reel of the plurality of symbol-bearing reels including the symbol clump is different than a probability of a second reel of the plurality of symbol-bearing reels including the symbol clump.

* * * * *